United States Patent [19]

Espagnacq et al.

[11] Patent Number: 4,697,521

[45] Date of Patent: Oct. 6, 1987

[54] METHOD FOR OPAQUING VISIBLE AND INFRARED RADIANCE AND SMOKE-PRODUCING AMMUNITION WHICH IMPLEMENTS THIS METHOD

[75] Inventors: André Espagnacq; Gerard D. Sauvestre, both of Bourges, France

[73] Assignee: Etat Francais, Paris, France

[21] Appl. No.: 517,940

[22] Filed: Jul. 27, 1983

[30] Foreign Application Priority Data

Jul. 27, 1982 [FR] France ..... 82 13055

[51] Int. Cl.[4] ..... C06D 3/00

[52] U.S. Cl. ..... 102/334; 89/1.11; 149/14; 149/15; 149/40; 149/87; 102/705

[58] Field of Search ..... 102/334, 705; 89/1.11; 149/14, 15, 40, 87

[56] References Cited

U.S. PATENT DOCUMENTS

| | | | |
|---|---|---|---|
| 4,100,102 | 7/1978 | Shaffer | 149/87 X |
| 4,291,629 | 9/1981 | Kezer | 102/334 |
| 4,353,303 | 10/1982 | Bell | 102/334 X |
| 4,391,197 | 7/1983 | Jacobsen | 102/334 |

*Primary Examiner*—Stephen J. Lechert, Jr.
*Attorney, Agent, or Firm*—Parkhurst & Oliff

[57] ABSTRACT

The invention concerns a method and a smoke-producing pyrotechnical ammunition to shield the visible and infrared radiance in a wave length included between 0.4 and 14 μm emitted by a target. First we produce instantly a first hot aerosol with a fast pyrotechnical composition, which masks the target through diffusion in the visible spectrum and with its emitting potential in the infrared zone. Then, we produce a second aerosol which contains hot carbon particles of which the size is included between 1 and 14 μm with a slow pyrotechnical composition for shielding mainly through diffraction the thermal image emitted by the target. The fast composition includes zinc and zinc oxide, potassium perchlorate, hexachlorobenzene or hexachloroethane powder and a binding agent. The slow composition includes a compound which generates carbon particles of 1 to 14 μm such as hexachlorobenzene hexachloroethane, naphtalene, anthracene, a reducing agent like a metal powder (magnesium) and an oxidizer like hexachlorobenzene and/or hexachloroethane.

12 Claims, 1 Drawing Figure

Figure 1:
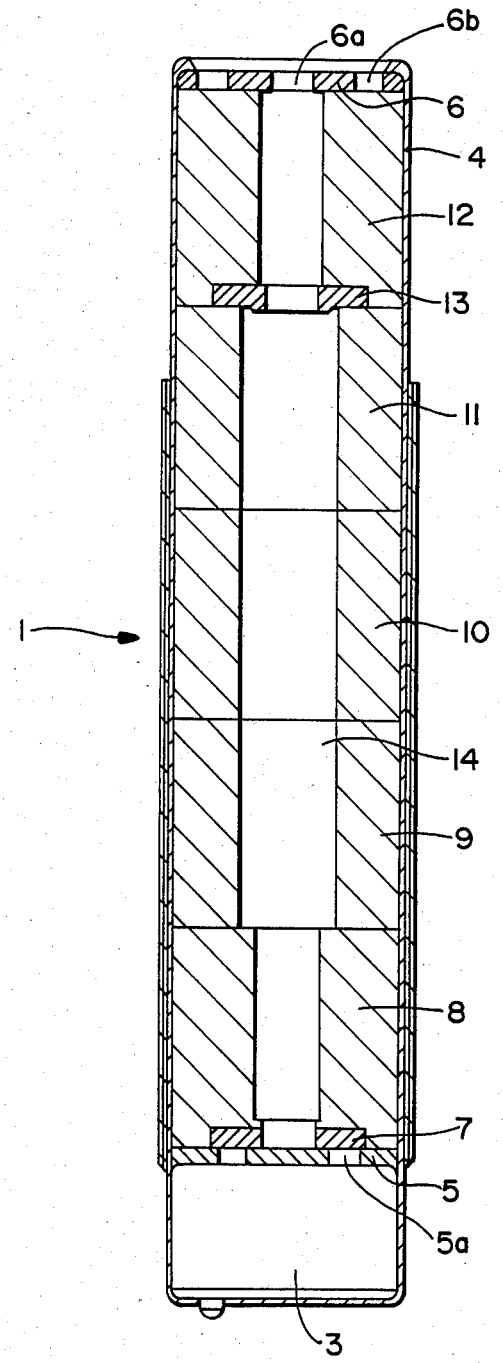

METHOD FOR OPAQUING VISIBLE AND INFRARED RADIANCE AND SMOKE-PRODUCING AMMUNITION WHICH IMPLEMENTS THIS METHOD

The technical sector of this invention is that of smoke-producing methods and ammunition which are designed to produce a smoke screen that makes it possible to shield any target by preventing transmission of infrared radiance emitted by it in order to make it undetectable to a sensor.

At present there exist few publications which discuss ammunition designed to produce smoke that is opaque to infrared radiance. However, the execution of classical smoke-producing ammunition or devices is well known. Those ammunition usually include a cylindrical pot inside which we place a pyrotechnical composition or tablets of pyrotechnical compositions which may or may not have a central channel. For more details, we can refer to French Pat. No. 2 249 590 which describes a smoke-producing device of which the emissions are entirely transparent to infrared radiance. This type of composition can generate a white smoke by producing zinc chloride or ammonium chloride, carbon being transformed into carbonic gas.

The emergence of new surveillance means (thermal cameras) has altered the factors in the problem because those means make it possible to identify a target from its thermal radiance proper in the transparency windows 3 to 6 μm and 7 to 14 μm. We already suggested the scattering of aerosols so as to shield the infrared radiance emitted by a target.

Hence, we know the French Pat. Nos. 2 299 617 and 2 309 828 which describe the forming of a liquid aerosol through hydrolysis of titanium or tin tetrachloride.

We then use a scattering and highly exothermal pyrotechnical composition, of the aluminum or boron/potassium perchlorate type in order to scatter titanium tetrachloride. However, this kind of aerosol which is comprised of hydrosoluble liquid droplets is not at all effective, it requires water or dampness and it has a very short lifespan, which is less than 20 s regardless of the volume of the scattering system. Furthermore, this system generates acid, corroding and toxic compounds.

We also know U.S. Pat. No. 2,396,265 which describes the scattering of solid particles from a mineral powder and a vector gas (compressed air, nitrogen, etc.) in order to prevent through scattering the thermal radiance of a target. However we must control the granulometry of the particles which are contained in the emitted aerosol because only final granulometry which comes close to the wave length of the radiance to be shielded is effective. And yet, we have observed that the production of a solid particle aerosol of which the diameter might be included between 1 and 14 μm, does not allow for the elimination of the thermal image of the target in an effective way and for a sufficient lapse of time due to sedimenting of the particles which intervenes. The lifespans which are obtained do not exceed 25 seconds.

We also know the French Pat. Nos. 2 294 422 and 2 294 432 which describe infrared decoys which transmit through combustion of a pyrotechnical composition, a high intensity flame which thus defines a source of infrared radiance which can be substituted for the radiance source comprised of the engine of the aircraft in the guidance system of the device launched against it.

The point is not to emit carbon particles of a particular size.

The purpose of this invention is to suggest a method and an ammunition in order to produce a smoke screen that prohibits transmission of infrared and visible radiance to completely shield a target for a sufficient lapse of time, or 40 to 50 s.

Therefore, the invention concerns a method for shielding visible and infrared radiance with a wave length included between 0.4 and 14 μm that is emitted by a target, characterized in that in an initial stage we produce instantly an initial hot aerosol which masks the target through the scattering in the visible spectrum and with its emitter power in the infrared world, and in a second stage we produce a second aerosol which contains mostly hot carbon particles measuring 1 to 14 μm in order to shield essentially through diffraction the thermal image that is transmitted by the target.

According to a particular implementation we generate the first and second aerosol from pyrotechnical compositions.

The invention also concerns a smoke-producing pyrotechnical ammunition for the implementation of the original method in that it includes a tube which is closed at both ends by a cover, at least one of those covers is equipped with one or more orifices, the tube enclosing at least a fast pyrotechnical composition which has a regimen of less than 1 s and a combustion speed which amounts to about 6 mm/s under operating pressure, in order to generate hot gasses with a flow equal at least to 160 g/s so as to shield through saturation the thermal image of the target, and at least a slow pyrotechnical composition which has a combustion speed of about 1 mm/s under operating pressure generating hot carbon particles, each composition equipped with a central channel, ignition means planned to initiate fast compositions.

The fast composition can be a tablet executed under pressure which includes a zinc or zinc oxide, potassium perchlorate, hexachlorobenzene or hexachloroethane powder and a binding agent comprised of neoprene.

The constituents of the fast composition can be selected according to the following mass ratios:

31% zinc,
12% zinc oxide,
16% potassium perchlorate,
31% hexachlorobenzene and/or hexachloroethane,
10% neoprene.

The slow composition can be a tablet which is executed under pressure and it includes a compound which generates carbon particles of which the size is included between about 1 and 14 μm, an oxidoreducing system which reacts to a temperature that exceeds 1000 degrees C. and a binding agent.

The reducing agent of the composition can be selected among metal powders especially magnesium; and the oxidizer can be represented by hexachlorobenzene, hexachloroethane or their mixture.

The slow composition can include the following ternary system:

15 to 25 parts in weight of magnesium powder,
50 to 85 parts in weight of hexachlorobenzene or hexachloroethane,
0 to 30 parts in weight of naphtalene.

The ammunition can include five tablets which are piled in the following order:

a fast composition tablet,
three successive slow composition tablets, a fast composition tablet, and an ignition tablet which is placed on contact with each of the fast composition tablets.

Advantageously the diameter of the central channel in the slow compositions is greater than that of the fast compositions.

One advantage of this invention rests in the fact that by combining two compositions which emit on the one hand an extremely hot aerosol to mask with its superior emitting potential the thermal image of the target and on the other hand a solid particle aerosol which preempts through diffraction the thermal image of the target one obtains instantly a protective screen for the target for a lapse of time which is sufficient amount to 40 to 50 s. Furthermore, the high intensity and exothermal combustion of the fast composition leads within the device to the reduction of the regimen setting of the slow composition as well as to an increase of its combustion speed during the initial operating seconds. This action makes it possible to increase the flow of emission of the ammunition and correlatedly to accrue particle concentration in the cloud of smoke. We therefore avoid a reduction of the aerosol density which corresponds to the short period located between the emission end due to the fast composition and the beginning of emission due to the slow composition. The result is an improvement of effectiveness and regularity in the smoke-producing screen against infrared radiance.

As it is already shown in what preceded we are implementing a highly exothermal composition which has great combustion speed. The compositions which meet these criteria are usually highly reducing metal powder bases for instance zinc or aluminum. This metal powder can be associated to a metal oxide like zinc oxide. The oxidizer can also be highly exothermal and those of the chlorate or perchlorate kind or perfectly suited without representing a limitation. Potassium perchlorate makes it possible to obtain excellent results. Therefore the reaction leads to chlorides which can be hydrolysed like zinc or aluminum chlorides. The oxidizer can be associated to saturated carbonic compounds which are partially or completely substituted by electronegative elements like chlorine or fluoride. As an example we will mention hexachlorobenzene or hexachloroethane. Obviously, we will improve the mechanical hold of the tablet by adding a binding agent which is not in and of itself a characteristic of the invention. The binding agents which are conventionally used in pyrotechnics can be implemented and we will mention as an illustration neoprene, vinyl polychloride, polyvinyl acetate, vinyl acetochloride, polyurethanes, etc. The respective percentages of constituents can be selected according to the sought goal.

The fast composition emits a smoke which is greyish to white, and it can be black according to the carbonic compound in use. Hence when we use hexachlorobenzene the smoke which is emitted becomes black. We should note that the fast composition burns completely and leaves no residue. The massic flow is increased and all of the smoke-producing material is transformed into smoke.

According to the invention, we associate to this fast composition a slow composition which includes a compound that generates carbon particles in order to produce through diffraction a screen which is opaque to infrared radiance from the target. Therefore we can use paraffins, condensed or not benzene compounds, naphtalene and anthracene, phenanthrene and naphtol make it especially possible to obtain good results. The oxidoreducing system must supply a combustion temperature which exceeds 1000 degrees C.; the metal powders which are associated to the classical oxidizers of the nitrate, perchlorate kind can be used. However we prefer, according to the invention, to optimize the pyrotechnical composition that is slow by using a compound which generates carbon particles and which is sufficiently ozidizing to react with the reducing agent, non substituted hydrocarbonic compounds. As an example, the hexachlorobenzene-napthalene couple makes it possible to execute slow pyrotechnical compositions which generate intense smoke that can mask infrared radiance of a target. Obviously, we can use a substituted hydrocarbonic compound in conjunction with a classical oxidizer. As such the binding agent does not represent a characteristic of this composition and it is used to reinforce the mechanical hold of the composition. However, we will choose preferably the macromolecular compounds of the fluoridated kind which participate in the combustion reaction through the intake of highly oxidizing fluoride molecules for instance vinylidene polyfluoride and also other polymers such as vinyl acetochloride copolymer, polystyrene, which is reticulated or not, methyl/styrene methacrilate copolymer and neoprene are adequate. The proportion of binding agent which is used can amount to 5 to 20 parts in weight not to exceed 25 parts in weight.

In order to prepare the pyrotechnical compositions according to the invention we can proceed in the following way or in an equivalent way.

First the metal powder is subjected to stoving at about 50 degrees C. for 24 hours. The solid compounds such as perchlorate, hexachlorobenzene and anthracene are sifted at about 0.5–0.65 mm. Then they are introduced in turn inside the vat of a mixer and mixed for 15 to 30 minutes. From the obtained mixture, we execute tablets which include a central channel under pressure equal to about $6.10^5$ Pa.

The invention will be better understood when reading the additional description which follows on implementation modes provided as examples in relation to a plate (FIG. 1) which represents a lengthwise section of ammunition according to the invention.

On the figure, we represented a smoke-producing ammunition 1 which is designed to be ejected from a launching tube that is not represented with a propeller 3 of the known type which is integrated to the ammunition. This ammunition includes a tubular envelope 4 made of steel closed at both ends with two covers 5 and 6. Cover 5, which is in the vicinity of the propeller 3, includes a number of holes or orifices **5*a* designed to enable the initiation of the ignition composition 7 during the launch. Cover 6 includes a central hole 6*a* and off-center holes 6*b*. Those various holes can be obstructed with easily melted mats. Inside the envelope 4, a fast composition tablet 8 is arranged, with three slow composition tablets 9, 10, 11, and a fast composition tablet 12. An ignition composition tablet 13 is placed at the base of the tablet 12** and it is used as the ignition relay.

On the figure, we see that the diameter of the central channel 14 of the tablets 9, 10, 11 is greater than that of the slow 8 and 12 due to a difference in combustion speed which exists between the fast and slow compositions. The central channel is a guide for ignition and its diameter depends on the nature of the smoke-producing composition.

As an example, we can execute ammunition with the following characteristics:
diameter of the envelope 80 mm,
height of the envelope 360 mm,
tablets 7 and 13 mass 22 g.
height 8 mm,
outer diameter: $\phi$ 50 mm,
diameter of the central hole: $\phi$ 18 mm,
tablets 8 and 12: mass 733 g,
height 69 mm,
diameter of a central hole: $\phi$ 30 mm.
tablets 9, 10 and 11: mass 388 g,
height 65 mm,
diameter of the central hole: $\phi$ 30 mm.

The overall mass of the ammunition is abut 4 kg and it includes 2370 kg in smoke-producing composition which provides an effective shield for 50 s.

As stated previously, the ammunition is designed to be launched in order to insert a screen which is opaque to infrared radiance between a target and a sensor, To this end, at the time of launch, igniting the propeller takes place for instance with an electric initiator. Under the activity of the propelling bloc, the ammunition is ejected at a distance of 20 to 70 meters from the target to be protected. As soon as the launching tube is out, the tablets 8 and 12 catch on fire with a response time that is lower than 1 s by way of tablets 7 and 13 which are initiated themselves by the propeller. Those tablets burn by emitting a white smoke through holes 5*a*, 6*a* which forms a barrel. Smoke emission on the trajectory, connected to the speed of the regimen setting of the tablets 8 and 12 makes it possible to set up an instantaneous protective screen. The emitted smoke is extremely hot and it represents an aerosol which masks the target by diffusing in the visible spectrum and with its superior emitting potential to that of the target in the infrared zone. Operating time amounts to about 7 or 9 s. After a 3 s delay, the tablets 9, 10, 11 are initiated under the combined action of the combustion from the ignition tablets and tablets 8 and 12. They emit a cloud of smoke which is black and which represents an aerosol that basically includes hot carbon particles of which the size is included between 1 and 14 m that essentially shield through diffraction the thermal image that is emitted by the target. Time of emission of the ammunition is included between 40 and 50 s in the infrared zone and 1 minute in the visible spectrum.

The following examples of fast and slow compositions are provided as an illustration:

FAST COMPOSITION: tablets executed under pressure of about $6.10^7$ Pa.

(1)
31% mass of zinc powder,
12% mass of zinc oxide,
16% mass of potassium perchlorate,
31% mass of hexachloroethane,
10% mass of neoprene binding agent.

(2)
31% mass of zinc powder,
12% mass of zinc oxide,
16% mass of potassium perchlorate,
31% mass of hexachloroethane,
10% mass of neoprene binding agent.

Those compositions display a combustion speed of 1.03 mm/s in open air and 6 mm/s under operating pressure in the ammunition.

The mechanical characteristics are as follows:
Resistance to compression Smc=$78.710^5$ Pa
Resistance to extension emc=3.31%.
Flaming temperature: 425 degrees C.
Activating energy: 25 389 Cal/g.

SLOW COMPOSITION: tablets executed under pressure of about $610^7$ Pa.

(1)
20 parts weight of magnesium powder,
80 parts weight of hexachlorobenzene,
10 parts weight of naphthalene,
10 parts weight of binding agent (vinylidene polyfluoride), (2)
20 parts of magnesium powder,
80 parts of hexachlorobenzene,
10 parts of anthracene,
10 parts of binding agent represented by vinylidene polyfluoride.

(3)
20 parts of magnesium powder,
70 parts of hexachlorobenzene,
10 parts of naphthalene,
5 parts of binding agent represented by neoprene.

(4)
20 parts of magnesium powder,
70 parts of hexachlorobenzene,
10 parts of naphthalene,
10 parts of binding agent represented by vinylidene polyfluoride.

(5)
18.5 parts of magnesium powder,
61.5 parts of hexachloroethane,
30 parts of naphtalene,
20 parts of chlorinated parrafin,
20 parts of binding agent represented by vinylidene polyfluoride.

(6)
20 parts of magnesium powder,
80 parts of hexachlorobenzene,
5 parts of binding agent represented by polyvinyl actate.

(7)
20 parts of magnesium powder,
80 parts of hexachlorobenzene,
20 parts of vinylidene polyfluoride.

Those compositions display combustion speed of 0.57 mm/s in open air and 1 mm/s under operating pressure in the ammunition.

The mechanical characteristics are as follows:
maximal constraint under uniaxial compression Smc: $178.10^5$ Pa,
distortion for maximal compression emc=0.87%.

In order to simulate aging, we subject the pyrotechnical compositions to respective temperatures of −40 degrees C. and +51 degrees C. for one month and we realize that the variations in their characteristics (combustion speed, mechanical hold, mass loss, size, etc.) are few.

We claim:

1. A method for shielding radiance emitted by a target in the visible spectrum and the infrared spectrum at wavelengths between about 0.4 and 14 $\mu$m comprising:

producing a first hot aerosol to shield the target primarily through diffusion in the visible spectrum and primarily through emission in the infrared zone;

producing a second hot aerosol substantially comprising hot carbon particles to shield the target primarily through diffraction, said hot carbon particles having diameters substantially between 1 and 14 μm.

2. The method according to claim 1, wherein said first and second aerosols are generated by pyrotechnical compositions.

3. A smoke-producing pyrotechnical ammunition comprising:

a tube closed at both ends by covers, at least one of said covers having one or more orifices;

at least one fast pyrotechnical composition enclosed within said tube having a regimen setting less than about 1 s and a combustion speed of about 6 mm/s under operating pressure for generating a flow of hot gasses of at least 160 g/s to shield primarily through saturation the thermal image of the target;

at least one slow pyrotechnical composition enclosed within said tube having a combustion speed of about 1 mm/s under operating pressure for generating a flow of hot carbon particles to shield primarily through diffraction the thermal image of the target;

ignition means for igniting said at least one fast composition; and wherein each of said fast and slow compositions has a central channel formed therein.

4. The ammunition according to claim 3, wherein said at least one slow composition has a regimen setting of about 3 s.

5. The ammunition according to claim 3, wherein said fast composition comprises zinc, zinc oxide, potassium perchlorate, neoprene and at least one substance selected from the group consisting of hexachlorobenzene and hexachloroethane.

6. The ammunition according to claim 5, wherein said fast composition comprises about the following mass percentages of the stated substances:

31% zinc;

12% zinc oxide;

17% potassium perchlorate

10% neoprene

31% hexachlorobenzene and/or hexachloroethane.

7. The ammunition according to claim 3, wherein said at least one slow composition further comprises a tablet executed under pressure from a compound which generates carbon particles between about 1 and 14 μm in size, an oxidoreducing system which reacts at a temperature exceeding about 1000° C., and a binding agent.

8. The ammunition according to claim 7, wherein said compound for generating carbon particles comprises at least one substance selected from the group consisting of hexachloroethane, hexachlorobenzene, napthalene, and anthracene.

9. The ammunition according to claim 8, wherein the oxidoreducing system comprises at least one reducing agent selected from the group consisting of metal powders, and at least one oxidizing agent selected from the group consisting of hexachlorobenzene and hexachloroethane.

10. An ammunition according to claim 9, wherein said slow composition comprises about the following portions of the stated substances:

15 to 25 parts by weight of zinc powder;

50 and 85 parts by weight of hexachlorobenzene and/or hexachloroethane;

0 to 30 parts by weight of anthracene.

11. The ammunition according to claim 10, wherein said fast and slow compositions and said ignition means are formed into tablets, and wherein said fast and slow composition tablets are disposed along an axial length of said tube in the following order:

a first fast composition tablet;

three successive slow composition tablets;

a second fast composition tablet; and at least one of said ignition tablets is placed in contact with each of said fast composition tablets.

12. The ammunition according to claim 3 wherein the central channel of said slow composition has a larger diameter than the central channel of said fast composition.

* * * * *